US007100673B2

(12) United States Patent
Botham et al.

(10) Patent No.: US 7,100,673 B2
(45) Date of Patent: Sep. 5, 2006

(54) ROLL SUPPORT DEVICE FOR CONTINUOUS METALLIC STRIP CASTING

(75) Inventors: Brian W. Botham, Retford (GB); Andrea De Luca, Remanzacco (IT); Alfredo Poloni, Fogliano-Redipuglia (IT); Edi Faggiani, Udine (IT); Nuredin Kapaj, Udine (IT)

(73) Assignee: Danieli & C. Officine Meccaniche, S.p.A., Buttrio (IT)

( * ) Notice: Subject to any disclaimer, the term of this patent is extended or adjusted under 35 U.S.C. 154(b) by 0 days.

(21) Appl. No.: 10/520,686

(22) PCT Filed: Jul. 10, 2003

(86) PCT No.: PCT/EP03/07484

§ 371 (c)(1),
(2), (4) Date: Jan. 6, 2005

(87) PCT Pub. No.: WO2004/007114

PCT Pub. Date: Jan. 22, 2004

(65) Prior Publication Data

US 2005/0173093 A1 Aug. 11, 2005

(30) Foreign Application Priority Data

Jul. 10, 2002 (IT) ..... MI2002A1505

(51) Int. Cl.
*B22D 11/06* (2006.01)

(52) U.S. Cl. ..... 164/480; 164/428

(58) Field of Classification Search ..... 164/428, 164/480

See application file for complete search history.

(56) References Cited

U.S. PATENT DOCUMENTS

| | | | | |
|---|---|---|---|---|
| 3,923,093 | A * | 12/1975 | LaTour | 164/442 |
| 5,470,592 | A * | 11/1995 | Steger | 425/3 |
| 6,820,680 | B1 * | 11/2004 | Fukase et al. | 164/483 |
| 2002/0135240 | A1 * | 9/2002 | Sawada et al. | 310/12 |

FOREIGN PATENT DOCUMENTS

| | | |
|---|---|---|
| EP | 0 903 190 A2 | 3/1999 |
| EP | 0 903 191 A2 | 3/1999 |

* cited by examiner

*Primary Examiner*—Kuang Y. Lin
(74) *Attorney, Agent, or Firm*—Stetina Brunda Garred & Brucker

(57) ABSTRACT

Support device for an assembly (14) of the casting rolls (11, 11') of a continuous metallic strip casting line comprising a movable support at each axial end. Such supports (17, 17', 19, 19') are provided with a hydraulic bearing (13) to reduce friction during motion with respect to the assembly. Between the movable supports of one of the rolls (11) and the assembly is located a hydraulic actuator (18), which thrusts the first roll (11') towards the second roll (11') against a stop (16). Between the second roll (11') and the assembly there are located magnetostrictive actuators which thrust the second roll (11') against the first roll (11). The device has a joint provided with a housing (22) inside which a telescopic tube (21) for the supply of the cooling water to conduits present in the rolls may slide. The housing (22) is connected to the assembly (14) by means of a bellows (27) allowing for oscillation.

9 Claims, 4 Drawing Sheets

ROLL SUPPORT DEVICE FOR CONTINUOUS METALLIC STRIP CASTING

FIELD OF THE INVENTION

Figure 1:
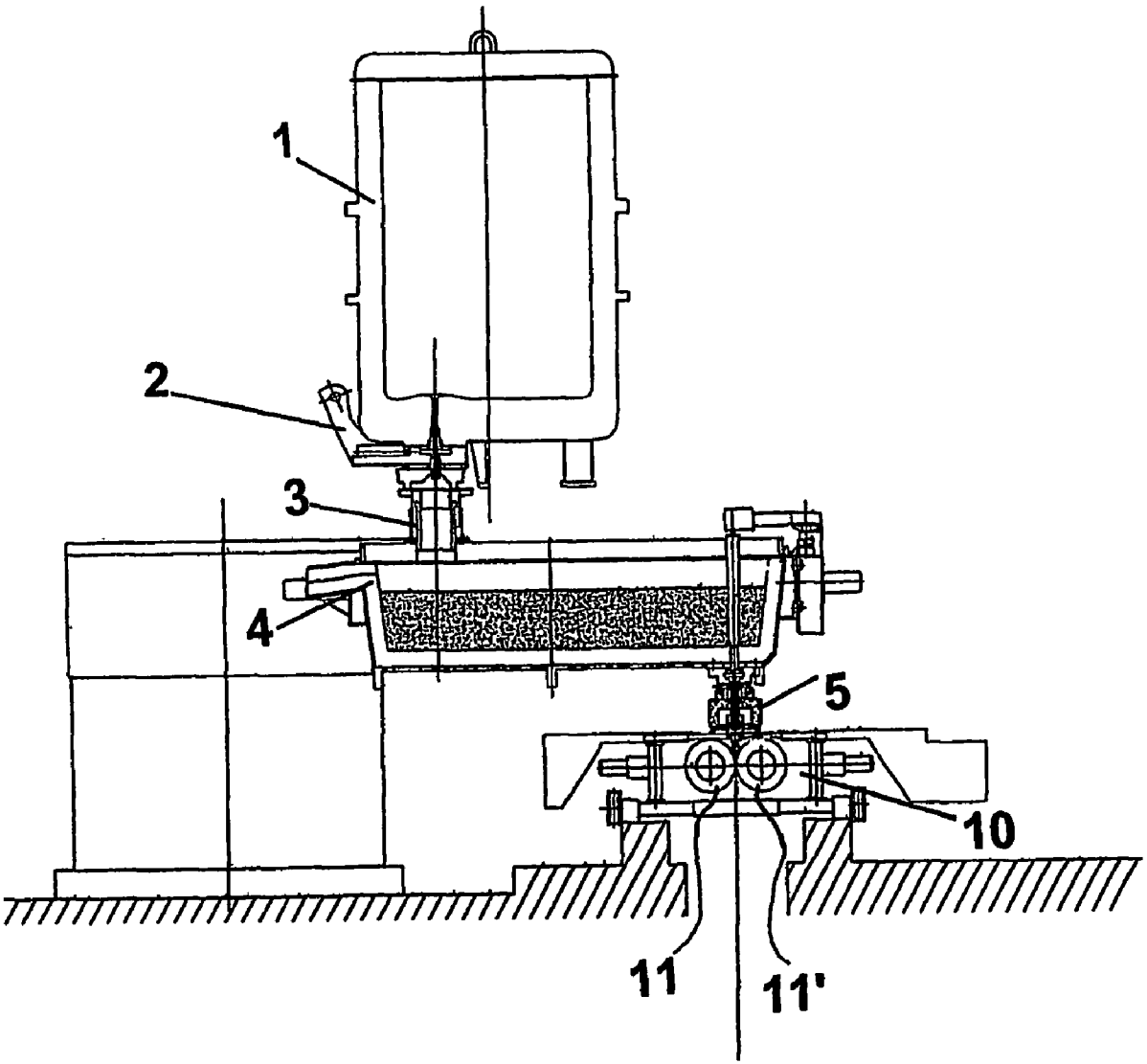

This invention relates to a support device of ingot mould rolls for continuous metallic strip casting, and particularly to a friction-reducing device for the rolls during their adjusting movement. It also relates to a method for controlling the distance between the rolls constituting an ingot mould.

STATE OF THE ART

Metallic strips are normally produced starting from continuously cast ingots or slabs, which are reduced in thickness by a series of subsequent operations comprising the preforging, hot and cold lamination, together with other intermediate treatments, for example heat treatments.

These operating methods involve very expensive plants and notable expenditure of energy.

Hence, for some time the tendency is that of reducing the plant and business costs by casting products with thickness as close as possible to that of the final product; consequently, following the introduction of continuous slab casting, the thickness of the latter is reduced from the conventional 200–300 mm to 60–100 mm obtained in the so-called "thin slab casting". However, even the passage from 60 mm to 2–3 mm, which is the typical thickness of a hot strip, requires a series of energetically taxing steps.

In view of the inherent disadvantages in casting bodies of significant thickness for reduction to thin strips the inherent advantages in directly casting metallic strips have been recognised since the second half of the $19^{th}$ Century, when Thomas Bessemer patented a machine for the continuous casting of steel strip provided with a couple of cooled metallic counter-rotating rolls set a small distance apart; the metal was cast in the space between the rolls, solidified upon contact with the cold surfaces of the latter and was finally extracted with a thickness equal to the distance between the facing surfaces of the rolls themselves.

Such extremely attractive technology has found practical uses for the casting of metals such as copper and aluminium only in the last decades of the 20th century, whilst for high smelting point metals and alloys, such as steel, at present the real industrial spread of such technology is still not manifest.

Numerous efforts are made in this field essentially to reduce production costs, the energy consumed and the environmental impact, and to produce thin strips directly usable just like they are, in particular applications in which for example surface quality is not a particular requirement, or to be considered the same as hot laminated strips for these uses in which thickness' of less than a millimetre are necessary.

Being established that the machine conceived by Bessemer in his time is still, in its general form, the most ideal for continuous metallic strip casting, the problems to solve for its effective use are very numerous and range from ensuring the tightness of the rolls at their flat ends, to the most suitable materials to survive the demanding working conditions, to the automated control of all the operations and the casting speed and drawing of the strip, up to its winding into a coil.

One of the more stressed points along the line are the casting rolls, which normally must ensure, in the presence of high thermal stresses, a constant quality of the cast strip and a suitable duration.

A characteristic of the continuous strip casting technology is that the strip thickness depends on the roll rotation speed, under the same casting conditions, such as steel solidification temperature, etc.

The casting rolls are one of the most complex parts of the casting line, since they must comprise, inter alia, a cooling system for the rolls themselves, and a delicate support system, which must also allow for, inter alia, the cast strip thickness adjustment. These requirements involve the presence of a number of elements implementing the various functions required by the plant. A solution adopted in known plants is arranging the rolls together with the devices performing many functions, directly related to their operation, such as the cooling system and the roll distance control in a complex assembly platform that allows for their quick replacement either in case of routine or extraordinary maintenance.

A continuous strip casting plant with a casting roll support platform comprising a complex system of roll supports is known from EP-A-903190 and EP-A-903191. In order to favour the displacement of the rolls during their side movements of removal and approaching during the casting, in such plant a linear bearing system is also provided.

A problem to be solved in the plants of this type is that of ensuring movements of approaching and removal which are as quick as possible also to face emergency conditions, such as when a quick and almost immediate distancing of the rolls is required to drop the molten metal which is still upon the rolls.

Another problem to be solved is that of improving the reliability of the supports to minimize the danger of seizure in operation, which may compromise the roll assembly itself with serious consequences.

SUMMARY OF THE INVENTION

It is therefore an object of the present invention to solve the above-mentioned problems by providing a support device which ensures the maximum reliability during the continuous metallic strip casting, an evenly thick strip, and which can be used in the presence of high temperature, and allows for the required displacement of the rolls with coordinate and sufficiently precise movements of the supports of the two opposite ends of each roll, to avoid lack of symmetry or planarity defects of the strip thickness. Such problems are solved according to claim 1 by support device on a assembly of a first and a second cooled casting rolls with a pair of plates abutted on each end of said pair of rolls, working as a mould for continuous metal strip casting, said first and second rolls having parallel axes and each of them being supported by at least one movable support element near to the axial ends, said movable support elements being suitable for allowing a mutual movement of approaching and distancing of said rolls of said pair, each movable support element associated with the first roll being connected to said assembly by means of its respective hydraulic actuator suitable for thrusting said first roll in the direction of said second roll and suitable for thrusting each support element against an abutting end element, each movable support element associated with the second roll being connected to said assembly by a magnetostrictive actuator and a load cell suitable for making said second roll perform movements of mutual approaching and distancing from said first roll, wherein a bar of the magnetostrictive actuator is provided with a preloading system and between each movable support element and said assembly there is provided at least one respective hydraulic bearing suitable for allowing sliding movement of each of said movable support elements with respect to said assembly.

Preferably, said assembly is the frame of a box containing the casting rolls and the other assemblies stated above.

Owing to the innovative characteristics of the present invention the roll supports, made by providing the hydrostatic bearings ensuring a fluid film between the rolls themselves and the support platform, reduce a lot the friction coefficient in the support. Such solution allows one to obtain better results also for use near to a heat source at a high temperature.

The casting process is kept to an optimal level thanks to the characteristics of the supports, which during the movement in the direction of mutual distancing and approaching of the rolls present a minimum friction both between the roll supports and the stationary frame of the box and between the joint for the feeding and draining the roll cooling water. The friction minimization obtained with the support device of the present invention is also important to ensure a symmetric process, otherwise different conditions can occur to the same roll with two different supports and the cast strip will consequently have a variable thickness along its width.

According to the a further aspect of the present invention, such problems are solved according to claim 7 by a method for controlling and adjusting the axial distance of the casting rolls for a continuous metallic strip casting implemented with the device of claim 1 comprising the following stages:

(a) operating said hydraulic actuator to make a first roll approach in the direction of the second roll until at least one respective movable support element associated with the first roll is in close contact against an abutting end element.

(b) emitting control signals to a magnetostrictive actuator depending on the signals received relevant to suitable process parameters;

(c) operating the magnetostrictive actuator to apply a force onto the movable supports associated with the second roll in the direction of a mutual approaching to or of a distancing from the first roll by sliding on at least a respective hydraulic bearing depending on the intensity variation of the roll separation force, so that the minimum gap between the rolls is kept constant.

LIST OF THE DRAWINGS

Figure 2:
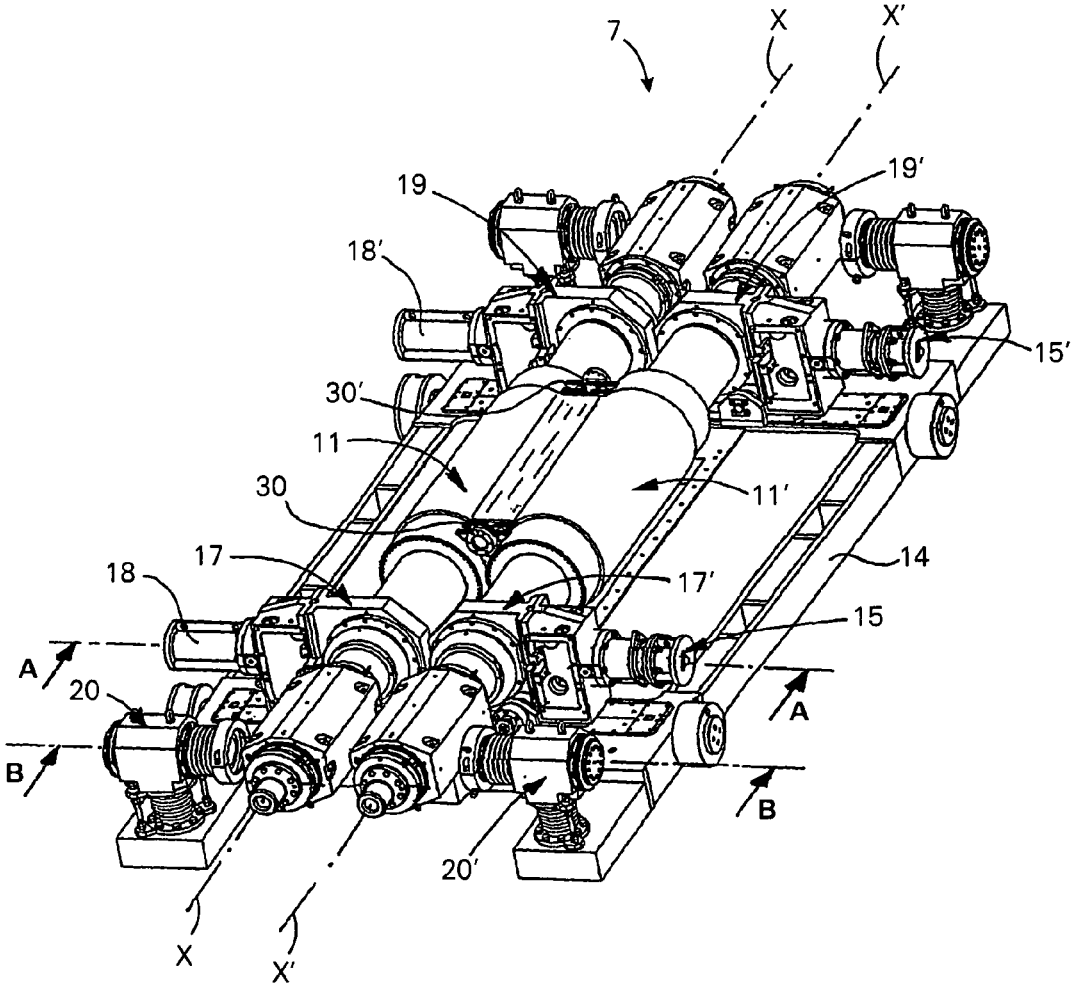
Figure 3:
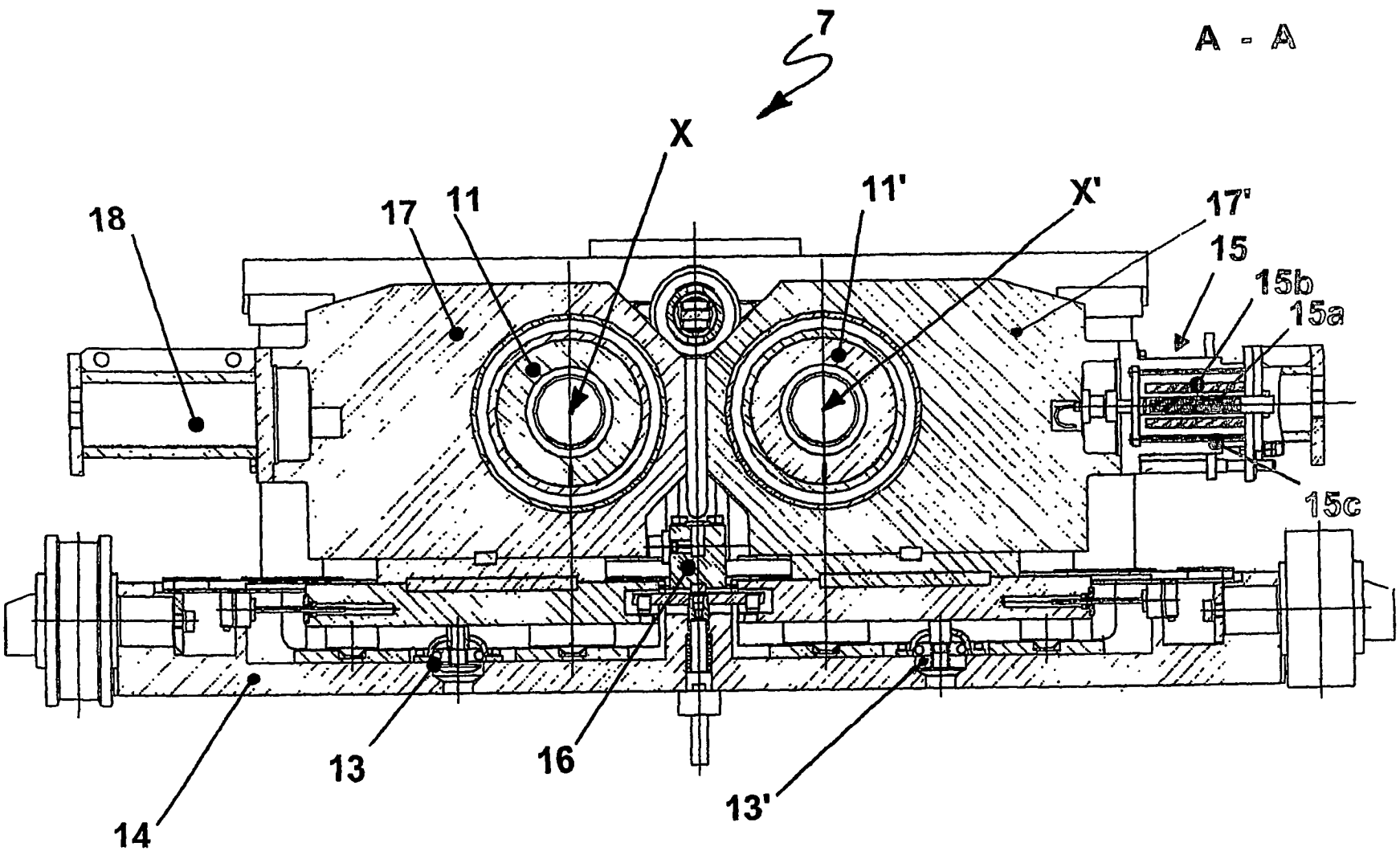
Figure 4:
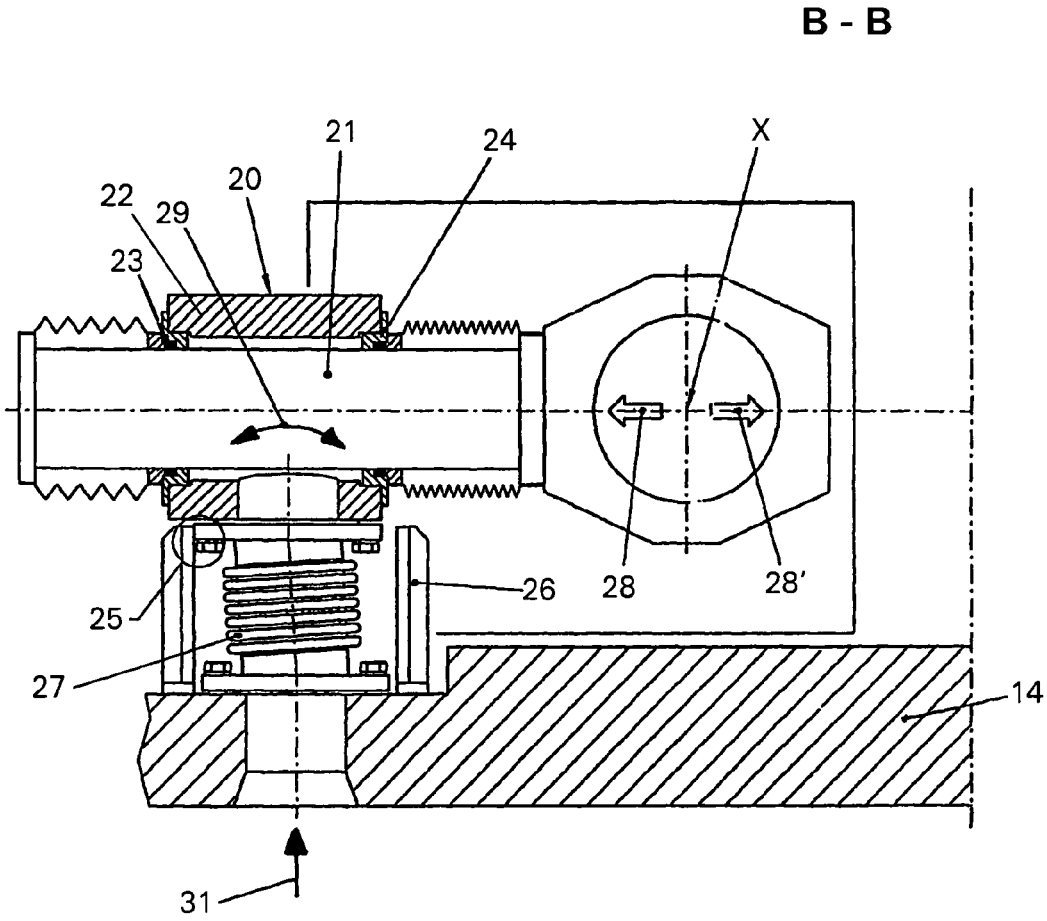

Further advantages obtainable with the present invention will be more evident to those skilled in the art by the following detailed description of a particular non-limiting embodiment of a support device for continuous metallic strip casting rolls with reference to the following Figures in which:

FIG. 1 schematically shows a section in a vertical plane of a metallic strip casting line;

FIG. 2 schematically shows an axonometric view of a roll support box;

FIG. 3 schematically shows a section of the roll support device of the invention;

FIG. 4 shows a section of a joint for the supply of the cooling fluid to the rolls being a part of a device according to a preferred aspect of the invention.

DETAILED DESCRIPTION OF THE INVENTION

With reference to the above-mentioned Figures, the continuous casting device provides for a ladle 1 which unloads the liquid steel load through an unloading slide valve 2 and a conduit 3 into a tundish 4. From the latter, the steel passes through a further conduit 5 into an optional under-tundish, not shown, or through an unloading device into an ingot mould 10 comprised of a pair of counter-rotating cooled casting rolls 11, 11', turning around their respective and mutually parallel axes X, X'. Two bulkheads indicated by the reference numeral 30 in FIG. 2 are provided to complete the ingot mould 10 and restrict the liquid metal in the direction of the roll axes between the rolls themselves by suitable means which thrust them against the roll end surfaces.

In such ingot mould 10, the liquid metal solidifies in contact with said rolls 11, 11' and is extracted from the ingot mould in the form of a strip at high temperature, said strip following, below said ingot mould, by gravity a substantially vertical path 12. The rolls and a number of other devices associated with them are arranged in a box 7, which is partially shown in greater detail in FIG. 2. Here a portion of the frame 14 of the box, particularly the bottom and the assemblies contained in the box, is shown.

The roll support device according to the present invention is shown in detail, by way of a non-limiting example of the scope and object of the invention in FIGS. 2 and 3 in a possible embodiment thereof.

The casting rolls 11, 11' are mounted on four support elements 17, 17', 19, 19' preferably two for each roll, which in turn rest on the frame 14 of the box 7. Between the support elements 17 and the frame 14 of the box 7 some hydraulic bearings 13, 13' are provided one of which is preferably provided near to each support element 17, 17'. During the casting operation, the roll 11 is kept stationary by pushing each support 17, 19 of the roll 11 against a stop 16, by means of one or more hydraulic cylinders 18, 18' preferably two, which push it towards the second roll 11'.

This roll 11 is conventionally known as "stationary" because during the casting operation it rests against the abutting end 16, while the other roll 11' is known as "movable" because, during the casting operations, it is the one which performs the operations necessary to a correct casting operation. The roll 11' is pushed towards the roll 11 by means of at least one magnetostrictive actuator 15 which in an advantageous embodiment are preferably two 15, 15' arranged each at each roll end. The cylinders 18, 18' are connected to the stationary roll 11 and the magnetostrictive actuators 15, 15' are connected to the movable roll 11' with their respective first end and are fixed to their second respective end to the frame 14 of the box 7, for example to the sides thereof, which are not shown in FIG. 3 to allow for a better view of the system.

The magnetostrictive actuators are devices based on the intense magnetostrictive effect of some metallic alloys. Such materials are capable of elongation, the so-called negative magnetostriction, in the direction of a magnetic field applied thereto. They are also capable to vary the orientation of the magnetic domains as a consequence of the compression or traction to which they are subjected.

Enhancement of the magnetostrictive effects occurs in the iron and rare earth alloys, such as samarium, terbium, dysprosium, etc. Such effect is maximum when the magnetic field reaches the saturation valve of the material. Furthermore, it ceases once the Curie temperature is attained. In the Table 1 below the main features of some magnetostrictive materials are listed, which are particularly suitable for use in the construction of magnetostrictive actuators.

| Material | Saturation Magnetostriction [μm/m] | Curie temperature [° C.] |
|---|---|---|
| $SmFe_2$ | −2100 | 402.85 |
| $TbFe_2$ | 2460 | 424.56 |
| $DyFe_2$ | 1260 | 362 |
| $HoFe_2$ | 200 | 333 |
| $ErFe_2$ | −300 | 317.45 |
| $TmFe^2$ | −210 | 287 |
| Fe | −9 | 770 |
| Ni | −33 | 354 |
| $CoFe_2O_4$ | −110 | — |

As such magnetostrictive materials are quite fragile, a preload system of the bar made of such material is suitably provided in the actuators to prevent the bar from being stressed by traction during operation with damaging consequences.

Such actuators offer optimal characteristics of use, among which there is the hihgh frequency good response in addition to the short reaction time and the high force applicable. For example, one of the magnetostrictive alloys presents an optimal frequency interval of 0–5 kHz, furthermore a bar in such material, 10 cm long, can elongate of more than 0.1 mm in 50 μs and a bar with a diameter of 30 mm can bear a force of 2 tons.

In the support device bearings 13, 13' are provided to reduce the friction coefficient during the movement of the casting rolls 11, 11' in the direction of mutual approaching and distancing of their axes X, X'. Such movements of the rolls 11, 11' which must be performed while keeping the parallelism between their axes X, X' with the utmost accuracy, have the purpose of controlling the thickness of the cast strip. The bearings used are advantageously of the hydrostatic type as shown in detail in FIG. 3. In this way, between the supports 17, 17', 19, 19' of both the movable and stationary rolls, and the frame 14 of the box 7 there is a fluid film which dramatically reduces the friction.

The operation of the support device of the pair of rolls according to the invention is described herewith below for one magnetostrictive actuator only, it is however understood that the second support of the roll at the second end of the pair of rolls also has the same technical features and operates in the same way. In the event that during the casting process the strip production speed, or some other casting parameter, such as the superheat of the liquid steel, is altered, the roll 11' may approach or distance itself from the roll 11, to keep the separation force of the roll themselves quite constant, thus ensuring constant working conditions, and particularly that the solidification complexion point remains the same, preferably near to the so-called "KISSING POINT" (KP).

When the separation force of the casting rolls 11, 11' begins to change, this means that the solidification point moves away from the KP point. In this case, the position of the movable roll 11' must change to make the separation force go back to the pre-established value by moving the movable roll in closer to or further away from the stationary roll, and this results in keeping the solidification complexion point near to the KP point.

In order to adjust the position of the movable roll 11', the magnetostrictive actuator 15 is connected to the support 17 of the movable roll 11', and a load cell is also provided between them. The same applies to the second end of the movable roll 11' driven by the second magnetostrictive actuator 15'. The magnetostrictive bar 15*a* is preloaded with a suitable preloading system 15*c* and the initial position of the movable roll 11' is ensured by a position transducer. In the initial position, the magnetostrictive bar is elongated by a pre-established value under the action of the magnetic field produced by electric coils 15*b* and this ensures the support 17' being thrust against the cast strip.

As soon as the intensity of the roll separation force varies, the control system varies the intensity of the magnetic field either to elongate or shorten the magnetostrictive bar as a function of the variation of the separation force, and as a result the positioning of the rolls is also varied in such a way that, by keeping the force constant, the complexion of the solidification at KP point is also ensured. The response of the system is very quick since the distance between the rolls can be varied in some tens of μs.

In an advantageous embodiment of the invention, the support device preferably further comprises one or more connection joints for conduits of the cooling liquid for the rolls, which are globally indicated by the reference numeral 20. One of these is schematically shown in FIG. 4. Cooling is required to keep the surface temperature of the rolls 11, 11' as constant as possible, by dissipating the metal solidification heat. Given the considerable amount of heat to be dissipated, the conduits of the cooling liquid must be duly sized. The cooling system must also allow for the mutual approaching and distancing movements of the rolls 11, 11', whether they are small, for example when varying the strip thickness, or big, when distancing the rolls 11, 11', for example in order to empty the ingot mould 10 of the liquid steel contained therein.

The joint 20 comprises a telescopic tube 21 arranged substantially horizontally, and in which liquid conduits are inserted both in the feeding direction to the rolls, and in the outlet direction from the rolls after the cooling. Preferably, there are provided two joints per each roll 11, 11' which are located at each end of each roll, one for feeding the liquid to the roll and the other for taking the liquid away from the roll. The telescopic tube 21 is coaxially inserted in a housing 22 provided with suitable gaskets 23, 24, which allow for the axial sliding displacement of the tube 21 in the housing 22 in case of big displacements of the rolls 11, 11'. Such displacements can be performed in emergency conditions by means of hydraulic cylinders arranged near to each support 17, 17', 19, 19', which in case of the movable roll 11' are arranged in series with the magnetostrictive actuator.

As can be seen from the FIG. 4, which shows one of the four roll supports 11 and 11', since the other three supports are made in the same way, consequently the bellows or compensator 27 allows the roll 11 to perform small displacements of the rolls during the casting in the direction of the arrows 28, 28' even if the axial sliding of the tube 21 in the housing 22 does not take place and correspond to small displacements of an oscillatory type of the joint 20 in the direction of the arrow 29 during the operation of the casting machine. Such movements must take place with as little friction as possible and the presence of the vertical bellows 27 allows for it, and they are recovered with no resistance while the axial sliding of the tube 21 would involve greater dissipation.

If big displacements are required, of the same type as those envisaged when opening the rolls for the emergency evacuation of the metal present therebetween in the ingot mould, the bellows or compensator 27 of the "stationary" roll 11 allows the housing 22 to make a first displacement until coming into tight contact with one of the stops or abutting end elements 25 and does not suffer from distortions which may damage it and subsequently the axial sliding of the tube 21 takes place, which allows for the axial distancing of the rolls. Both the stationary roll 11 and the movable roll 11' are opened in the same way.

Other bellows can be advantageously provided around the tube 21 for example in order to protect if from dust or other foreign elements. There are also provided support and gasket elements 23 and 24 comprising "O-ring" thereby ensuring the sealing from the water flowing between the tube 21 and the housing 22.

The cooling water flows in the vertical direction, for example in the direction of the arrow 31 in the tube comprising the vertical bellows 27, then it passes through holes, not shown in the figures, in the horizontal telescopic tube 21 and subsequently in the respective casting roll 11, 11'. The water, after having performed its cooling function, follows the path in reverse and passes from the roll 11, 11' to the telescopic pipe 21, then through holes in the vertical tube comprising the bellows 27.

By means of said joint for the conduits of water, or any other type of cooling liquid which is adapted to perform such a function, the global resistance of the support device in relation to the displacements commanded to the rolls 11, 11' and this presents the advantage that the distance between the rolls is self-regulated in a very precise manner, for example according to the casting speed, and that the strip thickness is even all along its width. Excessive friction in the supports, in fact, may compromise the integrity of the strip thickness uniformity.

The invention claimed is:

1. A support device on a assembly (14) of a first and a second cooled casting rolls (11, 11') with a pair of plates (30, 30') abutted on each end of said pair of rolls (11, 11'), working as a mould (10) for continuous metal strip casting, said first and second rolls (11, 11') having parallel axes (X,X') and each of them being supported by at least one movable support element (17, 17', 19, 19') near to the axial ends, said movable support elements (17, 17', 19, 19') being suitable for allowing a mutual movement of approaching and distancing of said rolls (11, 11') of said pair, each movable support element (17, 19) associated with the first roll (11) being connected to said assembly by means of its respective hydraulic actuator (18, 18') suitable for thrusting said first roll (11) in the direction of said second roll (11') and suitable for thrusting each support element (17, 17') against an abutting end element (16), each movable support element (17', 19') associated with the second roll (11') being connected to said assembly by a magnetostrictive actuator and a load cell suitable for making said second roll (11') perform movements of mutual approaching and distancing from said first roll (11), wherein a bar of the magnetostrictive actuator is provided with a preloading system and between each movable support element (17, 17', 19, 19') and said assembly (14) there is provided at least one respective hydraulic bearing (13, 13') suitable for allowing sliding movement of each of said movable support elements (17, 17', 19, 19') with respect to said assembly (14).

2. The device according to claim 1, wherein there is provided at least one joint (20) supporting a cooling liquid conduit between said rolls (11, 11') and said assembly suitable for allowing for mutual approaching and distancing of said rolls (11, 11') in an orthogonal direction to the axes.

3. The device according to claim 2, wherein said joint (20) comprises a telescopic tube (21) inserted substantially horizontally in a housing (22) connected to said assembly, said tube being suitable for sliding along its own axis in said housing.

4. The device according to claim 3, wherein a bellows or a compensator (27) is set between said assembly and said housing.

5. The device according to claim 4, wherein an abutment means (25, 26) is provided to limit the displacements of said housing in the direction of the axis of said telescopic tube (21).

6. A method for controlling and adjusting the axial distance of the casting rolls (11, 11') for a continuous metallic strip casting implemented with the device of claim 1 comprising the following stages:

a) operating said hydraulic actuator (18, 18') to make a first roll (11) approach in the direction of the second roll (11') until at least one respective movable support element (17, 19) associated with the first roll (11) is in close contact against an abutting end element (16).

b) emitting control signals to a magnetostrictive actuator depending on signals received relevant to suitable process parameters;

c) operating the magnetostrictive actuator to apply a force onto the movable supports elements (17', 19') associated with the second roll (11') in the direction of a mutual approaching to or of a distancing from the first roll (11) by sliding on at least a respective hydraulic bearing (13, 13') depending on the intensity variation of a roll separation force, so that a minimum gap between the rolls (11, 11') is kept constant.

7. The method according to claim 6, wherein a control system varies the intensity of magnetic fields either to elongate or shorten magnetostrictive bars comprised in said actuation means (15) as a function of the intensity variation of the separation force.

8. A support device on an assembly of first and second cooled casting rolls with a pair of plates abutted on each end of said pair of rolls, working as a mould for continuous metal strip casting, said first and second rolls having parallel axes and each roll being supported by at least one movable support element, said movable support elements being operative for allowing movement of approaching and distancing of said rolls, each movable support element associated with the first roll being connected to said assembly, each movable support element associated with the second roll being connected to said assembly by a magnetostrictive actuator operative to permit incremental movement of approaching and distancing between the first and second rolls.

9. The device according to claim 8 further comprising a control system operative to vary the intensity of magnetic fields about a magnetostrictive bar of the actuator to either elongate or shorten the magnetostrictive bar as a function of the separation force.

* * * * *